US005984559A

United States Patent [19]

Shiobara et al.

[11] Patent Number: 5,984,559

[45] Date of Patent: Nov. 16, 1999

[54] BALLPOINT PEN REFILL AND FABRICATION METHOD THEREOF

[75] Inventors: Toshikazu Shiobara; Kazuhiko Sasaki; Teruaki Fukasawa, all of Isesaki, Japan

[73] Assignee: Kabushiki Kaisha Pilot, Tokyo-to, Japan

[21] Appl. No.: 08/894,398

[22] PCT Filed: Dec. 11, 1996

[86] PCT No.: PCT/JP96/03619

§ 371 Date: Aug. 18, 1997

§ 102(e) Date: Aug. 18, 1997

[87] PCT Pub. No.: WO97/22483

PCT Pub. Date: Jun. 26, 1997

[30] Foreign Application Priority Data

| | | | |
|---|---|---|---|
| Dec. 19, 1995 | [JP] | Japan | 7-349185 |
| Dec. 27, 1995 | [JP] | Japan | 7-352809 |
| Mar. 15, 1996 | [JP] | Japan | 8-087514 |
| Jun. 27, 1996 | [JP] | Japan | 8-186737 |
| Jul. 19, 1996 | [JP] | Japan | 8-209108 |

[51] Int. Cl.[6] ..... B43K 7/10

[52] U.S. Cl. ..... 401/214; 401/209; 401/212; 401/216; 401/217; 401/219

[58] Field of Search ..... 401/208, 209, 401/212, 214, 216, 217, 219, 232, 236

[56] References Cited

U.S. PATENT DOCUMENTS

| | | | |
|---|---|---|---|
| 4,973,180 | 11/1990 | Hori | 401/209 |
| 5,277,510 | 1/1994 | Okamoto et al. | 401/214 |
| 5,678,942 | 10/1997 | Kobayashi et al. | 401/209 |

FOREIGN PATENT DOCUMENTS

| | | | |
|---|---|---|---|
| 494043 | 7/1976 | Australia | 401/219 |
| 461361 | 12/1913 | France | 401/214 |
| 63-252799 | 10/1988 | Japan . | |
| 5-58090 | 3/1993 | Japan | 401/214 |
| 6-83380 | 11/1994 | Japan . | |
| 7-237386 | 9/1995 | Japan . | |
| 7-237387 | 9/1995 | Japan . | |
| 7-237388 | 9/1995 | Japan . | |
| 8-39982 | 2/1996 | Japan . | |
| 8-258479 | 10/1996 | Japan . | |

*Primary Examiner*—Henry J. Recla
*Assistant Examiner*—Tuan Nguyen
*Attorney, Agent, or Firm*—Wenderoth, Lind & Ponack, L.L.P.

[57] ABSTRACT

A ballpoint pen refill which can be applied to a retractable ballpoint pen is provided. An ink 2 endowed with a thixotropic property and an ink follower 3 at the rear of this ink are contained within an ink tube 1 comprising a tip holder member 9 and an ink member 10. A ball 6 is held in a front end aperture 9*a* thereof. A ballpoint pen tip 4 having an inner reshaped surface 4*f* of a front end rim 4*b* that is formed into a spherical surface in the shape of the ball is fitted therein. A coil spring 7 that always presses the ball onto the inner reshaped surface is provided with a movable member 8 between the spring and ball. A stopper 5 provided with a ventilation means is fitted into a rear end of the ink tube. A partition portion 9*g* having an ink-flow passageway for restricting the amount of ink that flows and a rear end surface 9*c* is formed in an engagement portion 9*d* of the tip holder member 9 that is fitted in the ink member 10.

16 Claims, 3 Drawing Sheets

BALLPOINT PEN REFILL AND FABRICATION METHOD THEREOF

TECHNICAL FIELD

The present invention relates to a ballpoint pen refill that uses an ink which is accommodated within an ink-accommodating tube and which has a viscosity that reduces with shear (a thixotropic property) such that the viscosity thereof is high in a static state but drops when a ball rolls. More particularly, it relates to a ballpoint pen refill in which drying out or leakage of the ink from an end portion of the tip is prevented by a configuration in which a coil spring is disposed within a front end aperture of the ink-accommodating (ink) tube and presses against a ball, either directly or via a movable member, within an inner reshaped surface of a front end rim that holds the ball of the ballpoint pen tip.

BACKGROUND ART

A capped ballpoint pen of the prior-art shown in FIG. 7 uses an ink which is endowed with a thixotropic property and which is poured directly into an ink-accommodating tube 1. The ink 2 that is endowed with a thixotropic property, such that the viscosity thereof is high in a static state but drops when the ball rotates during writing, is accommodated within the ink-accommodating tube. An ink follower 3 that follows the consumption of the ink and also prevents the ink from flowing backwards, is inserted at a rear portion of this ink. An engagement portion 9*d* of a tip holder member 9 is fitted in the front end of the ink-accommodating tube, and a ballpoint pen tip 4 is fitted in a front end aperture 9*a* thereof. A stopper 5 provided with a ventilation means is fitted in the rear end of the ink-accommodating tube 1. This type of ballpoint pen refill is inserted into a penholder tube B in a state such that only a writing portion protrudes from the front end thereof, and a front end portion of this penholder tube is covered by a cap C.

The prior-art ink-accommodating tube 1, shown in FIG. 8, has a smaller-diameter portion 1*c* that is open at the front end and a larger-diameter portion 1*d* that is open at the rear end. The ink 2 endowed with a thixotropic property and the ink follower 3 at the rear of this ink are incorporated within the ink-accommodating tube 1. The ballpoint pen tip 4 is fitted into a front end aperture 1*a* of the ink-accommodating tube 1, and a coil spring 7 that always presses a ball 6 against an inner reshaped surface 4*f* of a front end rim portion 4*b* that holds the ball is also disposed therein. The stopper 5 provided with a ventilation means (such as an opening) is fitted into the rear end of the ink-accommodating tube 1. This example relates to a refill which uses an ink having a thixotropic property and which is poured directly into an ink-accommodating tube, whereby drying of the ink at the front end of the tip or leakage thereof is prevented.

In the prior-art, a ballpoint pen or refill that uses a low-viscosity ink (a water-based ink) necessitates a complicated structure. This complicated structure may be similar to that of an internal-wadding type of water-based ballpoint pen wherein ink is guided to a tip end portion by a relay core in which ink is absorbed by an ink-absorbing member of cotton-like fibers covered by an outer film. Another example of a complicated structure may be that of a pen-core type of water-based ballpoint pen that uses a pen core member having an ink-flow adjustment function that comprises comb grooves which pour the ink directly into the ink-accommodating tube, ink grooves, and air grooves. A ballpoint pen or ballpoint pen refill which is formed by the direct pouring of an ink endowed with a thixotropic property, which provides clear handwriting with the same smooth writing feeling as that of a low-viscosity ink, has an advantage in that it is simple to pour the ink directly into the ink-accommodating tube. This feature is obtained because, although the ink maintains a high viscosity in a static state, the viscosity drops at the instant at which a shearing action occurs in the ink in contact with the ball surface when the ball rotates, so that the ink becomes a fluid.

On the other hand, if a state is assumed in which an impact force is exerted on the refill or ballpoint pen, the nature of the ink ensures that a shear action is generated at the contact surface between the ink and the ink-accommodating tube in the types of refill shown in FIGS. 7 and 8 as prior-art examples. The entire body of ink vibrates and thus the weight of the ink itself exerts an impact force on the ink follower when the tip is orientated upward or on the ball when the tip is orientated downward. An ink follower has certain physical properties such as viscosity and the degree of wetting thereof with respect to the inner surfaces of the ink-accommodating tube. However, all that supports the impact loading exerted on the ball is the force that holds the ball, which is produced by the process of reshaping the front end rim holding the ball. Consequently, if the impact force exceeds the force holding the ball, the ball could push the front end rim wider and fall out.

Therefore, of these ballpoint pens that use an ink endowed with a thixotropic property that is poured directly into an ink-accommodating tube, the type of pen that has a writing portion covered by a cap having a clip that can be attached to and removed from clothing (as shown in the prior-art example of FIG. 7) is carried in a state in which the tip is orientated upwards, so that there is no problem when this refill is used in a capped type of ballpoint pen. However, another application for this refill might be in a retractable type of ballpoint pen in which the tip is in a downward-orientated state and a pressing action on a pressing member accommodated within the holder tube causes a writing portion to protrude from or retract into an opening portion at a front end of the holder tube. In this case, there is a danger that an impact during the protrusion/retraction operation or while the pen is being carried could cause the ball to fall from the front end of the tip. If the ball falls out, ink will flow from the front end of the tip and stain the tube and clothing. Consequently, this refill has not been used in a retractable type of ballpoint pen up until now.

An objective of the present invention is therefore to provide a ballpoint pen refill that can be used without problems in a retractable type of ballpoint pen by using a configuration that completely prevents leakage or dripping from the front end of the tip, even when the tip is orientated downward. This refill also prevents the ball from falling out when it is subjected to an impact force and, if the ball should fall out for some reason, prevents the ink from flowing out from the front end of the tip.

SUMMARY OF THE INVENTION

The present invention was devised in the light of these problems and provides means for preventing the ball from falling out due to an impact force that acts opposing a force caused by the endowment of a thixotropic property. An ink-accommodating tube is formed integrally of a tip holder member and an ink-accommodating member. Ink-flow passageways are formed in the tip holder member or an ink partitioning member that is disposed as a separate member within a connecting portion that links a smaller-diameter portion of the ink-accommodating tube (into which the tip is fitted) and a larger-diameter portion thereof (in which the ink is stored). The ink-flow passageways are formed of lateral grooves, which are formed in the radial direction relative to an axial core and which communicate with an ink-flow passageway, and longitudinal grooves which extend in the axial direction to connect the lateral grooves to a rear end surface and to restrict the amount of ink flowing. This configuration ensures that a large proportion of the impact pressure of ink that has been set vibrating by an impact is absorbed by the tip holder member or the rear end surface of the ink partitioning member. The ink loading from opening portions of the longitudinal grooves that regulate the amount of flow of the ink is further reduced by the bent ink passageways formed by the longitudinal and lateral grooves, so that the impact pressure exerted on the ball becomes extremely small.

Furthermore, the inner surface within the reshaped portion is formed to the same spherical shape as that of the ball. The reshaping is done by rolling the front end rim holding the ball of the ballpoint pen tip to press the ball into contact with the reshaped portion, as means for completely preventing ink leakage (or dripping) from the front end of the tip, even when the tip is orientated downward. This ensures that a mutual surface contact is obtained in a valve mechanism of the front end portion of the tip that is in contact with the ball that is subjected to the resilient force of the coil spring in the inner reshaped surface of the ballpoint pen tip that holds the ball, so that the sealing function thereof is completely achieved.

In addition, if the ball should happen to fall out for some reason, such as friction on the front end rim of the tip during writing, means for preventing outward flow of the ink from the front end of the tip is provided during the above described processing of the ballpoint pen tip. The means for preventing outward flow of the ink includes forming the ink guidance aperture that penetrates the rear aperture in such a manner that it has a predetermined length in the axial direction and the opening portion of the rear end aperture is maintained to be a circle. The means also includes forming as a tapered surface a connecting portion that links the front end portion to a core portion, which has a diameter larger than that of the front end portion and which has a front end portion orientated towards the ink-flow adjustment portion. This ensures that, if the ball should fall out, the movable member moves towards the front end so that the opening portion of the ink guidance aperture of the tip and the connection portion of the movable member are brought into contact to act as a novel valve mechanism, thus preventing the ink from flowing out of the front end of the tip.

This invention also relates to a ballpoint pen refill wherein a tip holder member has an ink-flow passage that does not reach as far as a rear end surface. Lateral grooves, which are formed in the radial direction and which communicate with the ink-flow passage, and longitudinal grooves which extend in the axial direction to connect the lateral grooves to the rear end surface, are provided in an engagement portion into which the ink-accommodating member fits. A partition portion is formed to comprise a rear end surface that regulates the amount of ink that flows through the longitudinal grooves. An ink endowed with a thixotropic property, such that the viscosity thereof is high in a static state but drops when a ball rotates, and an ink follower which is placed behind the ink to follow the consumption of the ink and prevent reverse flow of the ink are inserted into an ink-accommodating tube that is formed integrally with an ink-accommodating member in the engagement portion of the tip holder member. An inner reshaped surface of a front end rim that holds the ball is shaped to the same spherical surface as that of the ball. A ballpoint pen tip, which is formed to have an ink guidance aperture that penetrates the rear aperture to a predetermined length in the axial direction, where the opening portion of the rear end aperture is maintained to be a circle, is fitted into a front end aperture of the tip holder member. A coil spring that always presses the ball into the inner reshaped surface of the tip, either directly or via a movable member, is provided. A stopper provided with a ventilation means is fitted into a rear end of the ink-accommodating member. Furthermore, a movable member is disposed between the ball and the coil spring of the ballpoint pen refill. The moveable member comprises a pressing portion formed of a front end portion in contact with the ball surface, and a connecting portion that is a tapering surface linking the front end portion to a core portion. The core portion has a diameter larger than that of the front end portion and is positioned to the rear of the front end portion and in the vicinity thereof. The core portion also has an ink-flow adjustment portion provided to form ink passageways therearound.

Another aspect of this invention concerns an ink partitioning member within a connecting portion that links a smaller-diameter and a larger-diameter portion of an ink-accommodating tube which is made of a metal material. The smaller-diameter portion has a machined front end and the larger-diameter portion is closed at a rear end thereof. A front end surface of the ink partitioning member is a spring bearer portion that supports the rear end of the coil spring pressing against the ball. The ink partitioning member is formed of an ink-flow passage which opens onto a front end surface of the ink-flow passageway penetrating in the axial direction but which does not reach as far as a rear end surface. Lateral grooves which are formed in the radial direction communicate with the ink-flow passage, and longitudinal grooves which extend in the axial direction connect the lateral grooves to the rear end surface and restrict the amount of ink flowing. An ink endowed with a thixotropic property and an ink follower at the rear of the ink are inserted into the ink-accommodating tube. An inner reshaped surface of a front end rim that holds the ball is shaped to the same spherical surface as that of the ball. A ballpoint pen tip, which is formed to have an ink guidance aperture that penetrates the rear aperture to a predetermined length in the axial direction, where the opening portion of the rear end aperture is maintained to be a circle, is fitted into a front end aperture of the tip holder member. A coil spring that always presses the ball into the inner reshaped surface of the tip, either directly or via a movable member, is provided. A stopper having a ventilation means is fitted into a rear end of the ink-accommodating member. Furthermore, a movable member is disposed between the ball and the coil spring of the ballpoint pen refill. The moveable member comprises a pressing portion formed of a front end portion in contact with the ball surface, and a connecting portion that is a tapering surface linking the front end portion to a core portion. The core portion has a diameter larger than that of the front end portion and is positioned to the rear of the front end portion and in the vicinity thereof. The core portion also has an ink-flow adjustment portion provided to form ink passageways therearound.

The thus-configured ballpoint pen refill can be used safely in a retractable ballpoint pen in which a depressing action on a pressing member accommodated within the holder tube causes a writing portion to protrude from or retract into an opening portion at a front end of the holder tube. It can also be used when the pen is carried with the writing portion orientated downward. In other words, it is possible to provide an ink shock structure in the tip holder member or in the ink partitioning member in such a manner that, if a shock is exerted on the refill and the nature of the ink ensures that the entire ink body vibrates, the shock loading does not act on the ball and thus the ball is prevented from falling out. It is also possible to prevent leakage or dripping of ink from the front end of the tip. A tight connection such that the inner reshaped surface of a front end rim that holds the ball of the ballpoint pen tip is pressed and formed to have the same spherical surface as that of the ball is provided in order to prevent leakage or dripping of ink from the front end of the tip. In addition, if the ball should happen to fall out for some reason, the flow of ink from the front end of the tip can be prevented by a novel valve mechanism formed of the opening portion of the ink-guidance aperture of the tip and a ball-pressing portion of a movable member that presses against the ball by the resilience of the coil spring.

If a thixotropic property is imparted to the ink, a high viscosity is maintained when in a static state so that the ink can be poured directly into the ink-accommodating tube without having to use components such as an ink-absorbing body or relay core having an ink-flow adjustment function, or a pen core. Further, the viscosity of the ink drops instantly with the rotation of the ball so that a clear handwriting with a smooth writing feel is obtained. Problem points such as leakage of ink from the front end portion of the tip and the dropping out of the ball due to impact can be coped with by inserting the front end portion of the tip into a sealing member (using a resilient material such as silicone rubber) within a cap, in the same manner as the capped type of ballpoint pen shown in FIG. 7, to create a product having a market value that would be extremely favorable. Therefore, an invention has been provided for a ballpoint pen refill that can be applied to a retractable ballpoint pen, in which the tip is in a downward-orientated state and a pressing action on a pressing member accommodated within the holder tube causes a writing portion to protrude from or retract into an opening portion at a front end of the holder tube. The effect of this invention is to remove the nuisance of removing and replacing the cap by using the refill in a retractable type of ballpoint pen, with no changes from the functional point of view from the previously developed capped pens. This will produce higher levels of functionality and convenience and thus make it possible to develop a novel product such as a retractable ballpoint pen, or even extend that effect further to previously unknown designs.

DETAILED DESCRIPTION OF THE INVENTION

Embodiments of the ballpoint pen refill in accordance with this invention will be described below with reference to the accompanying drawings. Note that the same reference numbers are used in the description to refer to the same members and portions mentioned in the above description of the prior-art.

Figure 1:
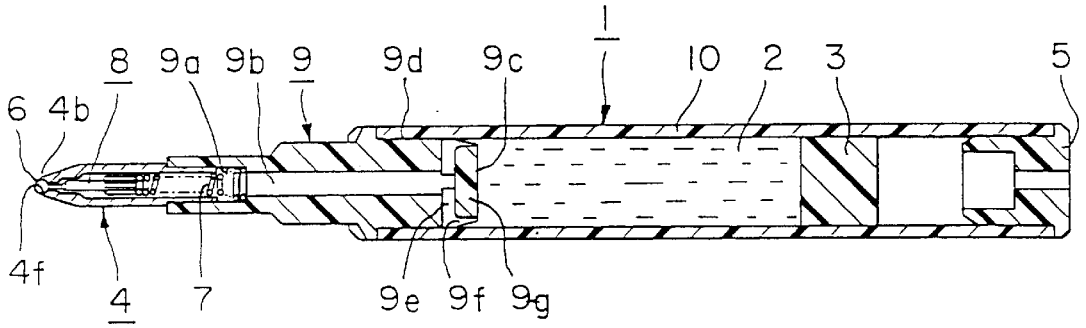
FIG. 1 is a longitudinal sectional view of a ballpoint pen refill in accordance with a first embodiment of this invention.

A longitudinal sectional view of a first embodiment of this invention is shown in FIG. 1. This embodiment is a ballpoint pen refill which can be installed in a retractable ballpoint pen and which is filled directly with an ink that is endowed with a thixotropic property. In this figure, reference number 1 denotes an ink-accommodating tube within which an ink 2 is accumulated and an ink follower 3 is inserted at the rear of the ink 2. A tip holder member 9 is fitted into a front end of this ink-accommodating tube 1 and a ballpoint pen tip 4 is fitted into a front end of the tip holder member 9. The ink 2 is endowed with a thixotropic property such that it has a high viscosity when in a static state but the viscosity drops when the ball rotates. The ink follower 3 is a paste-like substance that follows the consumption of the ink and also prevents back-flow of the ink. An inner reshaped surface 4*f* is formed in a front end portion of the ballpoint pen tip 4, as will be described below, and a ball 6 is held therein. A movable member 8 is incorporated within the ballpoint pen tip 4 upstream of the ball 6, pressed towards the ball 6 by a coil spring 7.

Figure 3:
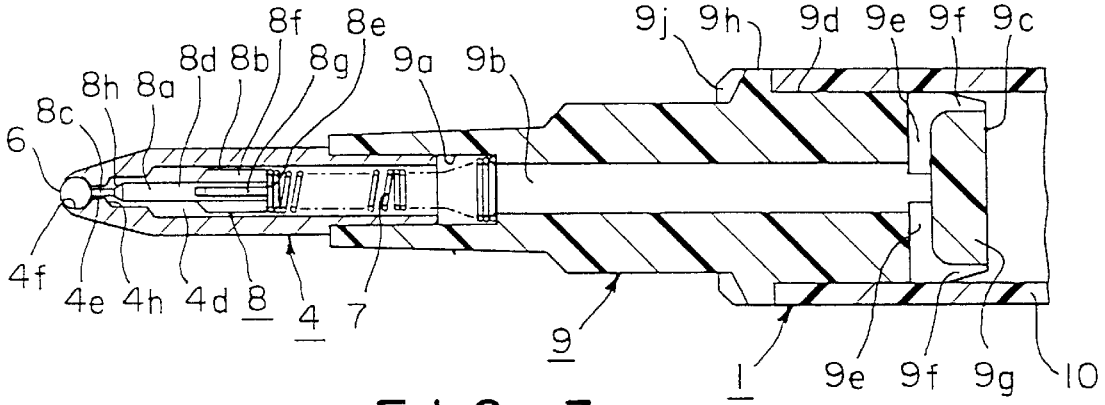
FIG. 3 is an enlarged longitudinal sectional view of an end portion of the refill of the first embodiment.

The tip holder member 9 opens at a front end aperture 9*a* into which the ballpoint pen tip 4 fits, as shown in the enlarged view of FIG. 3. An ink-flow passage 9*b* is provided communicating with this front end aperture 9*a*, and this passage 9*b* is terminated by a partition portion 9*g*. A protuberant hilt portion 9*h* is provided around the outer periphery of the tip holder member 9, in contact with a front end surface of an ink-accommodating member 10. A portion to the rear of the protuberant hilt portion 9*h* functions as the engagement portion 9*d* for the ink-accommodating member 10. This engagement portion 9*d* is provided with lateral grooves 9*e*, which are cut in the radial direction and which communicate with the ink-flow passage 9*b*, and longitudinal grooves 9*f*, which extend in the axial direction to connect the lateral grooves to a rear end surface 9*c* to form ink-flow passageways. An end surface on the outer side of the partition portion 9*g* forms the rear end surface 9*c* for restricting the amount of ink that flows.

Figure 2:
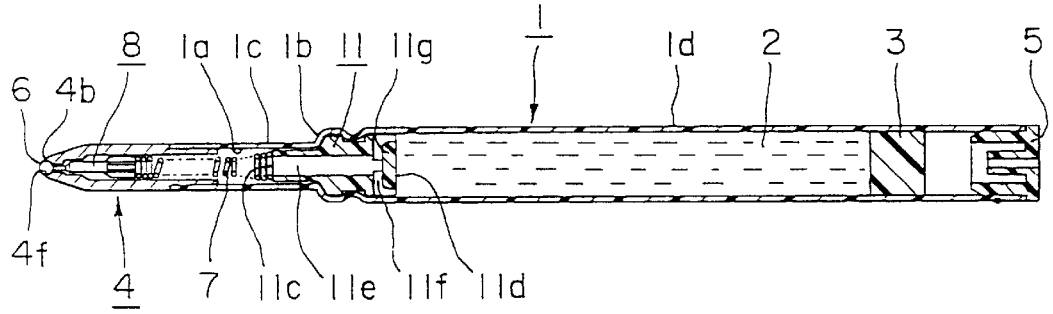
FIG. 2 is a longitudinal sectional view of a ballpoint pen refill in accordance with a second embodiment of this invention.

A longitudinal section through a ballpoint pen refill, which is filled directly with an ink endowed with a thixotropic property and which can be inserted into a retractable ballpoint pen in the same manner as the first embodiment, is shown in FIG. 2 as a second embodiment of this invention. The ballpoint pen refill of this aspect of the invention has an ink-accommodating tube 1 which is formed of a metal material. The ink-accommodating tube has a smaller-diameter portion 1*c* that is open at a front end and a larger-diameter portion 1*d* that is closed at a rear end. An ink partitioning member 11 is disposed within a connecting portion 1*b* that links the smaller-diameter portion and the larger-diameter portion. An ink 2 that is endowed with a thixotropic property is accommodated within the ink-accommodating tube, and an ink follower 3 is inserted at a rear portion of this ink. A ballpoint pen tip 4 is fitted into a front end aperture 1*a* of the smaller-diameter portion and a inner reshaped surface 4*f* is also formed in a front end portion of the ballpoint pen tip 4, with a ball 6 held therein. A movable member 8 is incorporated within the ballpoint pen tip 4 upstream of the ball 6 pressed towards the ball 6 by a coil spring 7. A stopper 5 provided with a ventilation means is fitted into a rear end of the larger-diameter portion.

Figure 4:
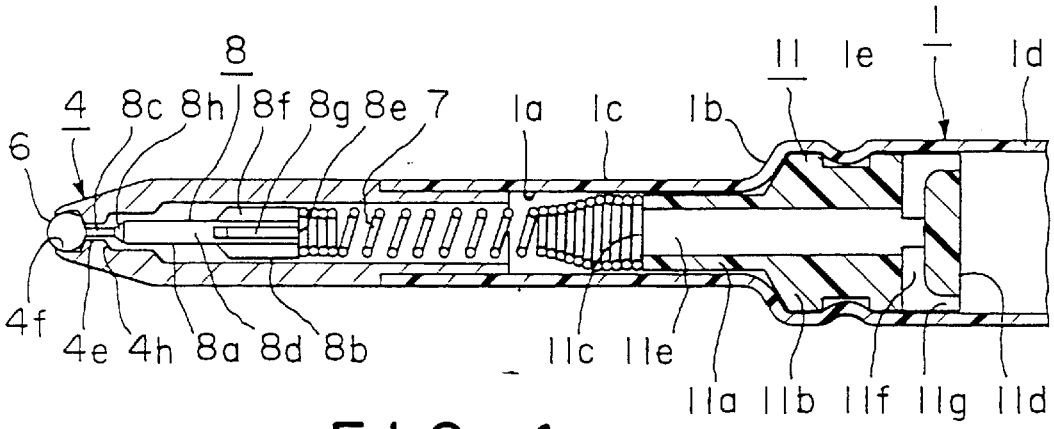
FIG. 4 is an enlarged longitudinal sectional view of a front end portion of the refill of the second embodiment.

As shown in the enlarged view of FIG. 4, the ink partitioning member 11 comprises a front end portion 11*a* positioned within the smaller-diameter portion 1*c* of the ink-accommodating tube 1 and a rear end portion 11*b* positioned within the large-diameter portion lid thereof. A front end surface of the front end portion 11*a* acts as a spring bearer surface 11*c* that supports a rear end of the coil spring 7. An ink-flow passage 11*e* that opens at the front end surface but does not penetrate a rear end surface 11*d* thereof extends to the rear end portion 11*b*. In the rear end portion are formed lateral grooves 11*f*, which are cut in the radial direction and which communicate with the ink-flow passage 11*e*, and longitudinal grooves 11*g*, which extend in the axial direction to connect the lateral grooves to a rear end surface 11*d* and restrict the amount of ink that flows. Note that a plurality of lateral and longitudinal grooves are provided in radially symmetrical positions for the ink-flow passageways, in a similar manner to that of the tip holder member 9 of the first embodiment, so that there is no problem even if a malfunction such as a blockage of one of the ink-flow passageways should occur. This also has an advantage from the point of view of component manufacture for injection-molding a plastic material, in that the cantilevered core pins for the ink-flow apertures can be supported and stabilized from both the upper and lower sides. Moreover, the ink partitioning member 11 disposed within the ink-accommodating tube 1 is preferably fixed integrally to the ink-accommodating tube by a deformation portion or portions 1*e*. These deformation portions are palatially deformed radially inward from the outer side of the ink-accommodating tube and engage the ink partitioning member 11 at a plurality of points or along a line. The fixing means could be any specific method such as the application of pressure, but it is important that the fixing should not be loosened even after long use.

The configurations of the above first and second embodiments ensure that, if an impact force is exerted on the refill when the tip end portion is orientated downward, virtually all of the shock loading due to the ink 2 vibrating within the ink-accommodating tube 1 is borne by the rear end surface 9*c* of the tip holder member 9 of the first embodiment or the rear end surface 11*d* of the ink partitioning member 11 of the second embodiment. Also, the loading of ink passing through the longitudinal grooves 9*f* or 11*g* that open into the respective rear end surface is borne by the lateral groove 9*e* or 11*f*, so that the shock loading of ink that is exerted on the ball 6 is limited to an extremely small quantity extending from the ink-flow passage 9*b* or 11*e* up to the ball. Therefore, there is no impact loading that would push the ball out and thus it is possible to prevent malfunctions in which the impact force exerted on the refill makes the ball fall out.

Figure 5A:
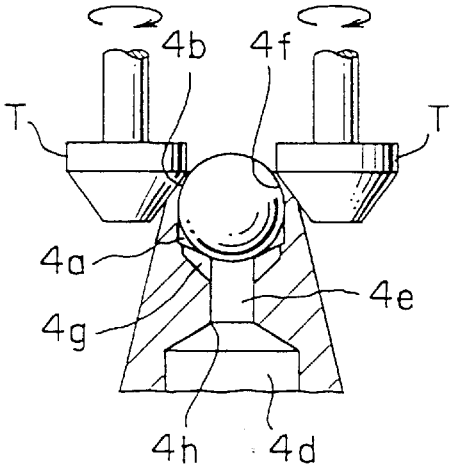
FIG. 5A is a view showing a reshaping process for a ballpoint pen tip.
Figure 5B:
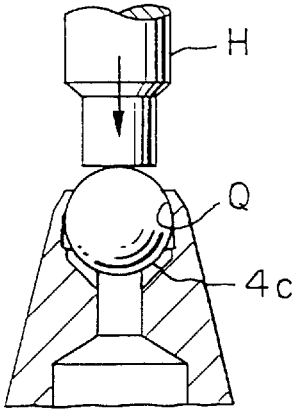
FIG. 5B is a view showing a hammering process of the ball.

The ballpoint pen tip 4 used in the present invention is obtained by substantially the same processing means as that of an ordinary ballpoint pen tip. As shown in the structural diagrams of the tip end portion of FIGS. 5(A) and 5(B), the ball 6 that has been inserted into a ball housing 4*a* is supported by a ball seat 4*c* in a base portion of the ball housing into which are cut a plurality of ink grooves 4*g*. Packing tools T are pressed against a front end rim 4*b* so that it is pressed into contact with the ball and is deformed to hold the ball. Thus, an inner reshaped surface 4*f* thereof is formed into a spherical surface that is the same as that of the ball. The upper surface of the ball which is exposed from the front end rim is then hammered by a hammer rod H so that the ball seat is plasmically deformed by a predetermined amount rearward, to form a structure such that a clearance Q is ensured around the ball within the ball housing.

Furthermore, the ballpoint pen tip 4 is configured in such a manner that the length of an ink guidance aperture 4*e* that extends between the ball housing 4*a* and a rear aperture 4*d* is set to be slightly longer than the ink grooves 4*g*. Also, the length of the ink guidance aperture is set to a design length such that it is not affected by any deformation of the ink guidance aperture that might occur during the processing of the ink grooves 4*g* that are cut into the ball seat 4*c* and the processing that causes the ball seat portion to deform plasmically by hammering the upper surface of the ball after the front end rim 4*b* has been reshaped. In addition, an opening portion 4*h* that opens at a rear aperture is formed into a circle.

This invention is arranged in such a manner that the above described ballpoint pen tip 4 is fitted in the front end aperture 9*a* of the tip holder member 9 of the first embodiment or the front end aperture 1*a* of the ink-accommodating tube 1 of the second embodiment. The coil spring 7 always presses the ball 6 against the inner reshaped surface 4*f* of the front end rim 4*b* holding the ball, with the movable member 8 therebetween. The coil spring 7 is supported at its rear end by the front end aperture 9*a* of the tip holder member 9 in the first embodiment or by the spring holder portion 11*c* of the ink partitioning member 11 in the second embodiment.

As shown in FIGS. 3 and 4, the movable member 8 inter-posed between the ball 6 and the coil spring 7 has a ball-pressing portion 8*a* including a front end portion 8*c*. The front end portion has a diameter less than that of the ink guidance aperture 4*e* of the ballpoint pen tip 4 and has a front end surface in contact with the ball surface. The movable member 8 also has an ink-flow adjustment portion 8*b* having a rear end surface 8*e* and defining therearound ink passageways 8*f*. The rear end surface 8*e* is in contact with the coil spring 7. In addition, the movable member 8 has a connection portion 8*h* that links the front end portion 8*c* to a core portion 8*d* thereof, which has a diameter larger than that of the front end portion. The connection portion 8*h* is formed as a tapering surface increasing in diameter towards the ink-flow adjustment portion 8*b*. The outer periphery of the core portion of the ink-flow adjustment portion 8*b* is sectioned into equal segments by a plurality of rib-like fins 8*g* of a diameter smaller than that of the rear aperture 4*d* of the tip. Note that, although rib-like fins are used in these embodiments to separate the ink passageways, the present invention is not limited thereto, provided that consideration is given to ensuring that the flow in the front end portion of the tip is smooth and there is no turbulence in the ink that has passed the position of the coil spring.

The present invention is configured in such a manner that the previously described relationship between the ballpoint pen tip 4 and the movable member 8 pressed by the coil spring 7 prevents leakage (or dripping) of ink from the front end of the tip when the refill is being carried or has been left standing with the tip in a downward-orientated state. This relationship also makes it possible to prevent leakage of ink from the front end of the tip if the ball should happen to fall out for some reason, such as friction on the front end rim of the tip during writing.

Figure 6:
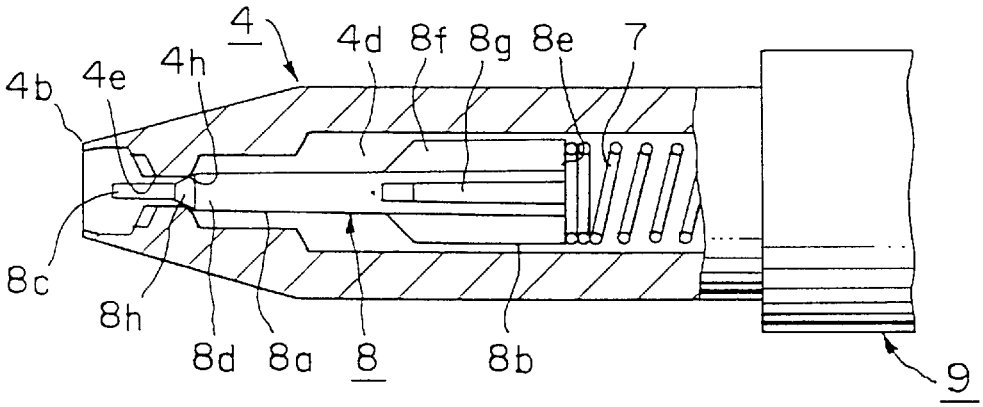
FIG. 6 is a sectional view of a tip end portion when the ball has fallen out.
Figure 7:
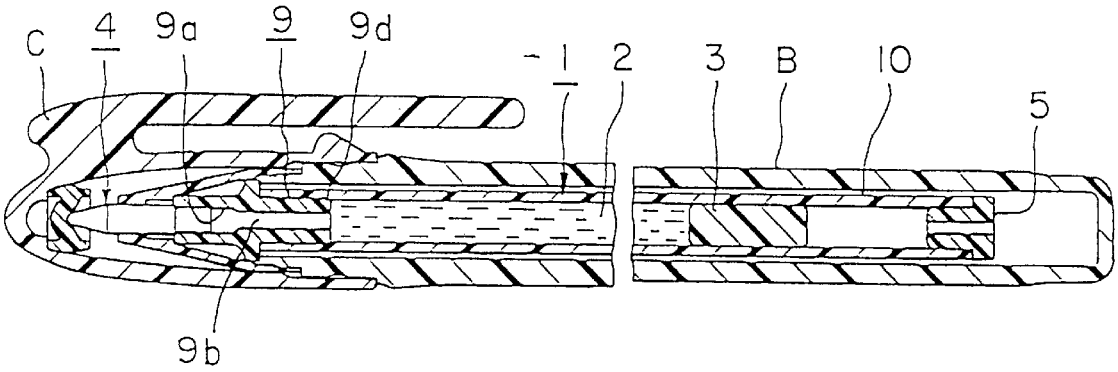
FIG. 7 PRIOR ART
FIG. 7 is a longitudinal sectional view of a prior-art ballpoint pen refill held in a capped type of ballpoint pen.
Figure 8:
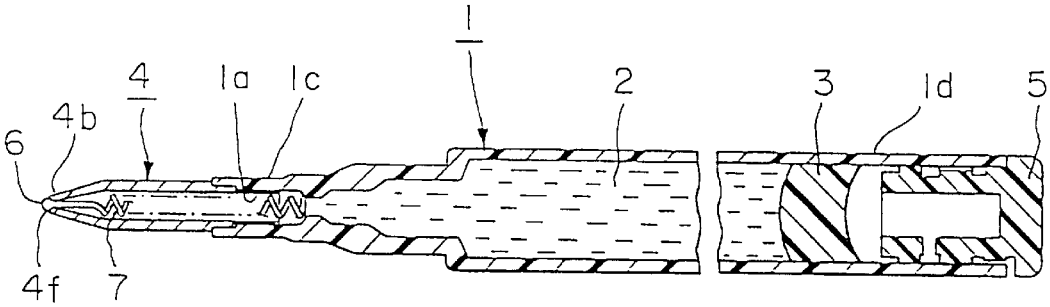
FIG. 8 PRIOR ART
FIG. 8 is a longitudinal sectional view of another prior-art ballpoint pen refill.

In other words, the inner reshaped surface 4*f* of the front end rim 4*b* holding the ball 6 of the ballpoint pen tip 4 is formed to have the same spherical surface as that of the ball. Therefore, the mutual contact surface of the reshaped surface 4*f* with the ball (which is pressed by the resilient force of the coil spring 7 via the movable member 8) is naturally in a surface contact, not linear contact. Thus, it is possible to greatly increase the reliability with which the leakage of ink is prevented from the front end of the tip. Furthermore, ink leakage from the front end of the tip can be prevented by the way in which the opening portion 4*h*, which opens into the rear aperture 4*d* of the ink guidance aperture 4*e* of the ballpoint pen tip 4, is formed as a circle. The connection (or shoulder) portion 8*h*, which connects the core portion 8*d* and the front end portion 8*c* of the ball-pressing portion 8*a* of the movable member 8, is formed as a tapered surface, as shown in FIG. 6. Consequently, if the ball should fall out, the movable member 8 moves towards the front end and, thus, the opening (or shoulder) portion 4*h* (i.e., the seat portion) of the ink guidance aperture of the tip and the connection (or shoulder) portion 8*h* (i.e., the valve portion) of the movable member are brought into contact to act as a novel valve mechanism.

Note that this embodiment is only one example of the configuration of the novel valve mechanism having a valve portion and a seat portion that prevents the outward flow of ink if the ball should fall out. It should be obvious that this novel valve mechanism can be configured in various other ways. For example, an oblique (tapered) surface connecting the opening portion to the rear aperture may be provided (i.e., around the periphery of the opening portion 4*h* at which the ink guidance aperture 4*e* of the ballpoint pen tip 4 opens into the rear aperture 4*d*). Alternatively, a protuberant valve portion (not shown in the figure) may be provided in contact with that oblique surface instead of the connection portion 8*h* in the vicinity of the front end portion 8*c* of the ball-pressing portion 8*a* of the movable member 8.

The ballpoint pen refill of the present invention is intended to be inserted into a retractable type of ballpoint pen, but there would be no particular problem using it within a capped type of ballpoint pen. It should be noted, however, that there is another type of pen in which there is an air aperture at the front end side of the refill (in the embodiments of this invention, the air entrance opening is in the stopper), for replenishing air to match the ink used in writing. Evaporation of ink from this air aperture is prevented by replacing the cap. If this type of refill is used in the tip holder member 9 shown in FIG. 3, the atmospheric flow in the rearward and forward directions within the holder tube is blocked by the protuberant hilt portion 9*h* coming into contact with a matching stepped portion of the holder tube (not shown in the figure). The atmospheric flow in the rearward and forward directions is blocked in the ink-accommodating tube 1 shown in FIG. 4 by the connecting portion 1*b* between the smaller-diameter portion 1*c* and the larger-diameter portion 1*d* coming into contact with a stepped portion of the holder tube (not shown in the figure). Therefore, to make the invention applicable to this type of capped ballpoint pen, using the tip holder member 9 shown in FIG. 3 for example, air grooves 9*j* could be provided opening onto an outer peripheral surface that extends in the axial direction of the protuberant hilt portion 9*h*. This causes air pressurized by the replacing of the cap on the holder tube to flow through the air grooves 9*j* towards the large-capacity rear portion of the holder tube, thus preventing abuse of the capabilities of the refill.

A configuration devised with the above or similar means ensures that the ballpoint pen refill of the present invention is provided with a structure that completely prevents leakage or dripping from the front end of the tip, even when the tip is orientated downward. It also prevents the ball from falling out when it is subjected to an impact force. Furthermore, if the ball should fall out for some reason, the configuration prevents the ink from flowing out from the front end of the tip. Therefore, the invention provides a ballpoint pen refill that can be used safely in a retractable type of ballpoint pen.

Industrial Applicability

The ballpoint pen refill of the present invention as described above can be applied to a wide range of retractable ballpoint pens.

We claim:

1. A ballpoint pen refill comprising:

an ink tube containing ink having a thixotropic property, said ink tube having a front end and a rear end;

an ink follower within said ink tube, said ink follower being positioned behind said ink such that said ink follower moves with consumption of said ink and prevents reverse flow of said ink;

a stopper having a ventilation opening, said stopper being connected to said rear end of said ink tube;

a tip holder member including a longitudinal ink passage and a front end aperture, said longitudinal ink passage communicating with said front end aperture, said tip holder member further including a rear engagement portion connected to said front end of said ink tube;

wherein said rear engagement portion has at least one lateral groove communicating with said longitudinal ink passage and extending radially therefrom, and at least one longitudinal groove communicating with an outer end of said at least one lateral groove and extending in a rearward direction therefrom, said at least one lateral groove and said at least one longitudinal groove forming at least one ink flow path between said longitudinal ink passage and said ink tube, said at least one ink flow path forming a partition portion at a rear surface of said rear engagement portion for restricting the ink flow from said ink tube to said longitudinal ink passage;

a ballpoint pen tip connected to said front end aperture of said tip holder member, said ballpoint pen tip having a front end rim and a ball, said front end rim having a spherical inner surface complementary to an outer surface of said ball, wherein said ball is rotatably held by said front end rim; and a spring within said ballpoint pen tip, wherein said spring presses said ball against said spherical inner surface of said front end rim.

2. The ballpoint pen refill of claim 1, wherein said longitudinal ink passage is located on a center longitudinal axis of said tip holder member.

3. The ballpoint pen refill of claim 1, further comprising a movable member between said ball and said spring for transmitting force from said spring to said ball.

4. The ballpoint pen refill of claim 2, wherein said movable member has a valve portion and said ballpoint pen tip has an ink guidance aperture, said ink guidance aperture having a seat portion on a rear end thereof, said valve portion of said movable member being arranged to engage said seat portion if said ball falls out of said ballpoint pen tip, whereby leakage from said ballpoint pen tip can be prevented.

5. The ballpoint pen tip of claim 4, wherein said valve portion of said movable member is a tapered shoulder portion.

6. The ballpoint pen tip of claim 4, wherein said seat portion of said ballpoint pen tip is a tapered shoulder portion.

7. The ballpoint pen refill of claim 3, wherein said movable member has an ink-flow adjustment portion, said ink-flow adjustment portion having a plurality of longitudinal fins thereon, said longitudinal fins extending radially outward.

8. The ballpoint pen refill of claim 7, wherein said plurality of longitudinal fins define longitudinal ink passageways around said ink flow adjustment portion of said movable member.

9. A ballpoint pen refill comprising:

an ink tube formed of metal and having a front end and a rear end, said ink tube including a small-diameter portion having an opening at said front end, a large-diameter portion at a rear end and a connecting portion between said small-diameter portion and said large-diameter portion, said ink tube containing ink having a thixotropic property;

an ink follower within said ink tube, said ink follower being positioned behind said ink such that said ink follower moves with consumption of said ink and prevents reverse flow of said ink;

a stopper having a ventilation opening, said stopper being connected to said rear end of said ink tube;

an ink partitioning member fitted within said connecting portion of said ink tube, said ink partitioning member including a front end portion with a spring bearer surface, a rear end portion extending into said large-diameter portion of said ink tube, and a longitudinal ink passage opening at said spring bearer surface and extending to said rear end portion;

wherein said rear end portion of said ink partitioning member has at least one lateral groove communicating with said longitudinal ink passage and extending radially therefrom, and at least one longitudinal groove communicating with an outer end of said at least one lateral groove and extending in a rearward direction therefrom, said at least one lateral groove and said at least one longitudinal groove forming at least one ink flow path between said longitudinal ink passage and said large-diameter portion of said ink tube, said rear end portion of said ink partitioning member having a rear end surface for restricting the ink flow from said large-diameter portion of said ink tube to said longitudinal ink passage;

a ballpoint pen tip connected to said small-diameter portion of said ink tube, said ballpoint pen tip having a front end rim and a ball, said front end rim having a spherical inner surface complementary to an outer surface of said ball, wherein said ball is rotatably held by said front end rim;

a movable member within said ballpoint pen tip adjacent to said ball; and a spring within said ballpoint pen tip between said movable member and said spring bearer surface of said ink partitioning member, wherein said spring presses said ball against said spherical inner surface of said front end rim.

10. The ballpoint pen refill of claim 9, wherein said longitudinal ink passage is located on a center longitudinal axis of said ink partitioning member.

11. The ballpoint pen refill of claim 9, wherein said movable member includes:

a front end portion with a front end surface in contact with said ball;

an ink-flow adjustment portion having a rear surface in contact with said spring; and a core portion between said front end portion and said ink-flow adjustment portion, said core portion having a larger diameter than said front end portion such that a valve portion is formed between said core portion and said front end portion.

12. The ballpoint pen tip of claim 11, wherein said valve portion of said movable member is a tapered shoulder portion.

13. The ballpoint pen refill of claim 11, wherein said ballpoint pen tip has an ink guidance aperture, said ink guidance aperture having a seat portion on a rear end thereof, said valve portion of said movable member being arranged to engage said seat portion if said ball falls out of said ballpoint pen tip, whereby leakage from said ballpoint pen tip can be prevented.

14. The ballpoint pen tip of claim 13, wherein said valve portion of said movable member is a tapered shoulder portion.

15. The ballpoint pen refill of claim 11, wherein said ink-flow adjustment portion has a plurality of longitudinal fins thereon, said longitudinal fins extending radially outward.

16. The ballpoint pen refill of claim 15, wherein said plurality of longitudinal fins define longitudinal ink passageways around said ink flow adjustment portion.

* * * * *